United States Patent [19]

Chantry et al.

[11] Patent Number: 4,734,837

[45] Date of Patent: Mar. 29, 1988

[54] VARIABLE ILLUMINATION LIGHT FIXTURE

[76] Inventors: Lance D. Chantry; Leo J. Blackman, both of 374 13th St., Brooklyn, N.Y. 11215

[21] Appl. No.: 9,698

[22] Filed: Feb. 2, 1987

[51] Int. Cl.[4] ..... F21V 1/06

[52] U.S. Cl. ..... 362/352

[58] Field of Search ..... 362/352, 351, 358, 361, 362/357

[56] References Cited

U.S. PATENT DOCUMENTS 1,502,471 7/1924 Hlavacek ..... 362/352

*Primary Examiner*—Larry I. Schwartz

*Attorney, Agent, or Firm*—Schiller, Pandiscio & Kusmer

[57] ABSTRACT

A variable illumination light fixture which permits the level of illumination of the light fixture to be adjusted not only by dimming or brightening the intensity of the light bulb itself, but also by simultaneously closing off or opening up the fixture's light bulb.

6 Claims, 6 Drawing Figures

VARIABLE ILLUMINATION LIGHT FIXTURE

FIELD OF THE INVENTION

This invention relates to light fixtures in general, and more particularly to variable illumination light fixtures.

BACKGROUND OF THE INVENTION

People have long desired to be able to adjust the level of illumination of a light fixture so as to accommodate various lighting needs. For example, reading might require one level of illumination whereas background lighting might dictate a different level of illumination. To accommodate these differing lighting needs, various lighting arrangements have been developed which permit the level of illumination of the light fixture to be varied. It is believed that such existing lighting arrangements all rely solely on the use of dimmer switches to brighten or dim the intensity of the fixture's one or more light bulbs so as to adjust the level of illumination of the light fixture.

OBJECTS OF THE INVENTION

The principal object of the present invention is to provide a new variable illumination light fixture which permits the level of illumination of the light fixture to be adjusted not only by brightening or dimming the intensity of the fixture's one or more light bulbs, but also by simultaneously opening up to view or closing off from view the fixture's one or more light bulbs.

Another object of the present invention is to provide a variable illumination light fixture which is simple to construct, inexpensive to manufacture, and reliable in operation.

SUMMARY OF THE INVENTION

These and other objects of the present invention are achieved by a new light fixture which comprises (a) at least one light bulb, (b) a book-like enclosure for containing the at least one light bulb, the book-like enclosure comprising a spine-like enclosure base, a pair of cover-like panels hinged to the spine-like enclosure base, and a light-pervious bellows attached to the spine-like enclosure base and extending between the two cover-like panels, (c) means for alternatively opening up or closing down the book-like enclosure by moving the enclosure's cover-like panels away from or towards one another, respectively, and (d) means for alternatively brightening or dimming the intensity of the at least one light bulb contained within the book-like enclosure, the means for alternatively brightening or dimming the intensity of the at least one light bulb being linked to the means for alternatively opening up or closing down the book-like enclosure so that (1) the book-like enclosure can be opened up and the intensity of the at least one light bulb simultaneously increased so as to increase the illumination of the light fixture, or (2) the book-like enclosure can be closed down and the intensity of the at least one light bulb simultaneously decreased so as to decrease the illumination of the light fixture.

BRIEF DESCRIPTION OF THE DRAWINGS

Still other objects and features of the present invention will be more fully disclosed or rendered obvious in the following detailed description of the preferred embodiment of the present invention, which is to be considered together with the accompanying drawings wherein like figures refer to like parts and further wherein.

DETAILED DESCRIPTION OF THE PREFERRED EMBODIMENT

Figure 1:
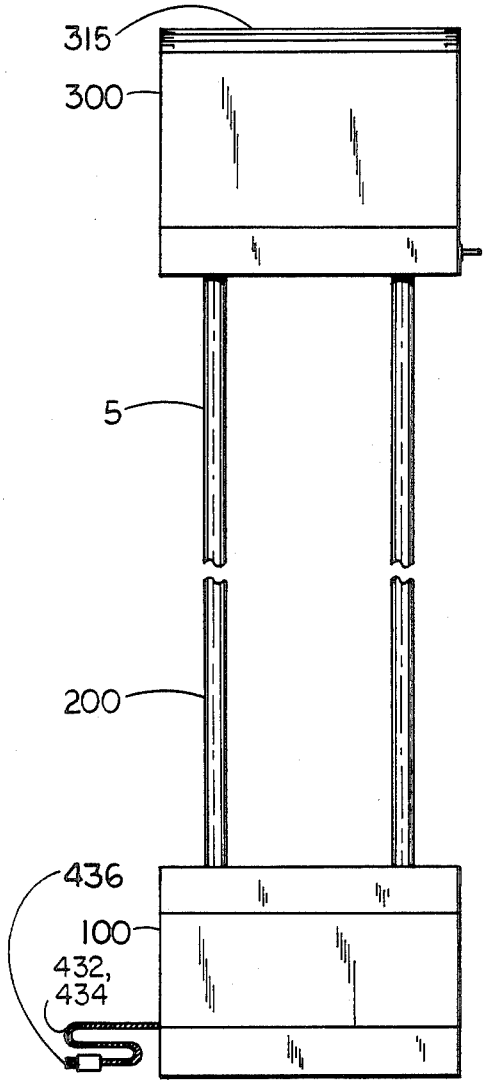
FIG. 1 is an elevational view of one side of the light fixture which constitutes the preferred embodiment of the invention.
Figure 2:
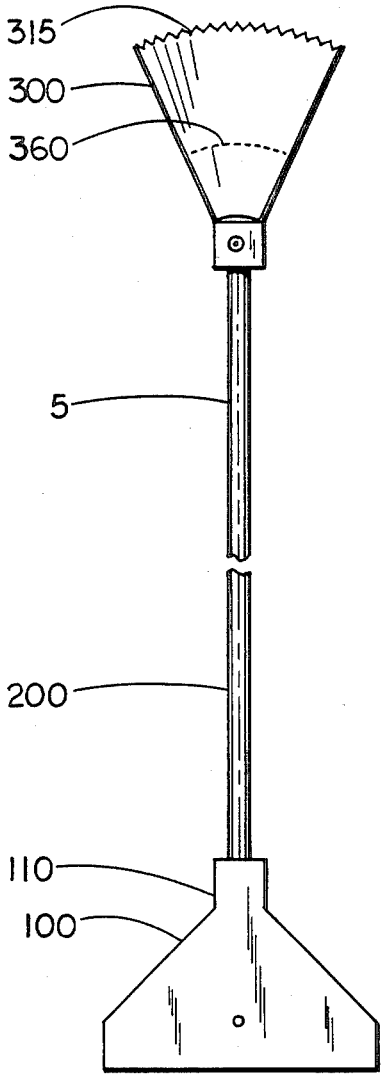
FIG. 2 is an elevational view of one end of the same light fixture.

Looking first at FIGS. 1–4, the novel light fixture 5 generally comprises a base 100, a pair of posts 200, a book-like enclosure 300 and electrical means 400.

Base 100 serves as a base or stand for the entire light fixture 5. Base 100 comprises a bottom plate 105, a pair of side walls 110, a pair of end walls 115 and a top plate 120. Bottom plate 105, side walls 110, end walls 115 and top plate 120 are all formed out of one or more rigid materials, e.g. stainless steel or aluminum, and are all fastened together, e.g. by bolting or screwing or welding, so as to form a single rigid structure. An opening 130 is formed in one of the end walls 115, and a pair of openings 135 are formed in top plate 120.

Posts 200 are attached to the light fixture's base 100 and serve to support the book-like enclosure 300 above base 100. More particularly, one of the posts 200 is disposed in each of the openings 135 formed in the base's top plate 120. Posts 200 are formed out of a rigid material, e.g. stainless steel or aluminum, and are hollow so as to allow electrical wires to pass therethrough, as will hereinafter be described in further detail.

Book-like enclosure 300 is mounted atop posts 200 and serves to enclose much of the electrical means 400, including the fixture's light bulb. Enclosure 300 is essentially a book-like structure comprising a spine-like enclosure base 305, a pair of cover-like panels 310 hinged to the spine-like enclosure base 305, and a light-pervious bellows 315 attached to the spine-like enclosure base 305 and extending between the two cover-like panels 310.

More specifically, the spine-like enclosure base 305 of book-like enclosure 300 comprises a base plate 320, a pair of side walls 325, and a pair of end walls 330. A mounting bracket 335 is attached to base plate 320 and extends upward from base plate 320 and between side walls 325 and end walls 330. A hole 340 is formed in one of the end walls 330 and a hole 345 is formed in the top surface of mounting bracket 335. A pair or openings 347 are formed in base plate 320. One of the posts 200 is disposed in each of the openings 347 formed in base plate 320, whereby the book-like enclosure 300 is supported above base 100.

Figure 5:
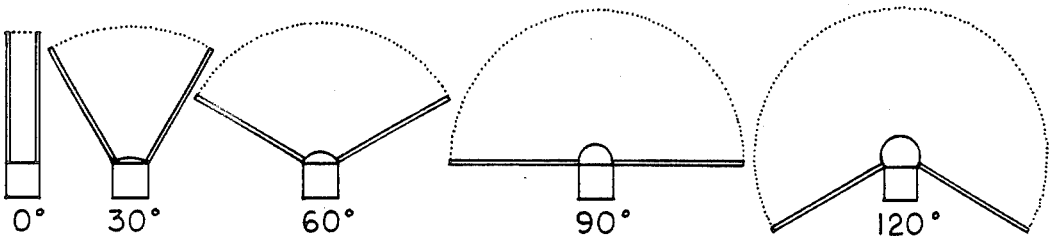
FIG. 5 is a series of views illustrating how the light fixture's book-like enclosure may be opened up or closed down to a variety of different positions.

The cover-like panels 310 are attached to side walls 325 of the spine-like enclosure base 305. More specifically, one panel 310 is attached to each side wall 325 by means of a hinge 350. This construction permits each panel 310 to pivot about the top end of its associated side wall 325 in the manner illustrated in FIG. 5. Panels 310 are formed out of a rigid material which is preferably light-impervious, e.g. stainless steel or aluminum. A guide track 355 is attached to the inside surface of each panel 310. Guide tracks 355 extend perpendicular to hinges 350 and cooperate with a pair of servo motors (hereinafter described in further detail) to effect the opening and closing of the panels 310 relative to one another.

The light-pervious bellows 315 is attached to the spine-like enclosure base 305 and extends between the two cover-like panels 310 so as to form a variable-sized hood for the book-like enclosure 300. More specifically, bellows 315 is attached to the two ends of the two cover-like panels 310. Bellows 315 is constructed with a folded pattern so that it will successfully form a hood or enclosure over the top end of the spine-like enclosure base 305 regardless of the particular angular position of the two pivoting panels 310. See FIG. 5. Bellows 315 is formed out of a light-pervious, preferably translucent material, e.g. paper or translucent vinyl or cloth or a highly perforated metal foil, and includes a plurality of ventilation holes 360 which are sized and positioned so as to vent heat from the interior of enclosure 300.

Electrical means 400 comprises a light bulb 402 (FIGS. 3 and 6), a switch 404 (FIGS. 3 and 6), a pair of servos 406A,406B (FIG. 3 and 6), a DC power supply circuit 408 (FIG. 6), a motor control circuit 410 (Fig. 6) for alternatively opening up or closing down panels 310 relative to one another in response to operator movement of switch 404, and a lamp dimmer circuit 412 (FIG. 6) for simultaneously brightening or dimming the light bulb 402 in response to movement of switch 404.

Light bulb 402 is attached to mounting bracket 335 by positioning it in hole 345 and securing it in place, so that the bulb resides inside of book-like enclosure 300. Bulb 402 is wired into lamp dimmer circuit 412 as will hereinafter be described in detail. Bulb 402 is preferably a 120 volt, 100 watt, halogen lamp type of bulb.

Switch 404 is an ordinary double-pole, double-throw, spring-return-to-center toggle switch of the sort well known in the art. Switch 404 is wired into servos 406A,406B and motor control circuit 410 as will hereinafter be described in detail Switch 404 is attached to the spine-like enclosure base 305 by positioning it in the hole 340 formed in one of the base's end walls 330.

Servos 406A,406B are also attached to mounting bracket 335 so that they reside inside of enclosure 300. Each of the servos 406 includes a servo motor 414 (labelled either 414A or 414B in FIG. 6), an associated 5K ohm servo potentiometer, or "pot", 416 (labelled either 416A or 416B in FIG. 6), and an arm 418 (FIG. 3) which is attached to the drive shaft 420 (FIG. 3) of the servo motor 414 near the arm's inner end so that the arm rotates in conjunction with that motor's drive shaft. Each of the arms 418 has its outer end attached by a pin 422 (FIGS. 3 and 4) to guide tracks 355 which are mounted on panels 310. On account of the foregoing construction, when servo motors 414 move the ends of arms 418 outward, panels 310 open outward, and when servo motors 414 move the ends of arms 418 inward, panels 310 close inward. Servo motors 414A,414B are both wired into switch 404, servo pot 416A is wired into motor control circuit 410, and servo pot 416B is wired into lamp dimmer circuit 412, as will hereinafter be described in further detail.

Figure 6:
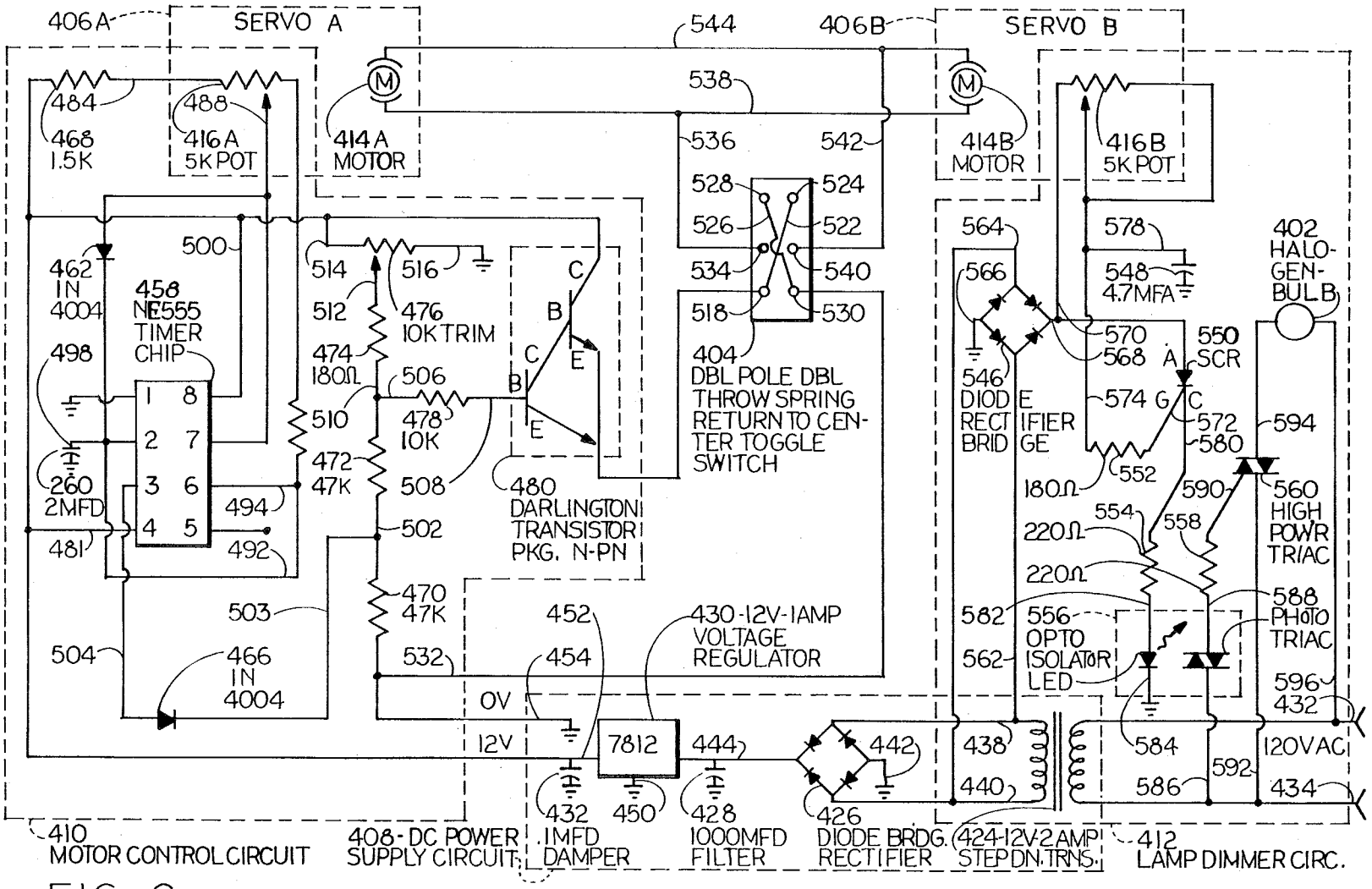
FIG. 6 is a circuit diagram illustrating how the same light fixture's electrical components are interconnected with one another.

Looking next principally at FIG. 6, DC power supply circuit 408 is adapted to take the 120 volt, alternating line current available from an ordinary wall outlet and convert it to the 12 volt direct current power supply required by the fixture's motor control circuit 410. DC power supply circuit 420 comprises a 12 volt, 2 amp step-down transformer 424, a diode bridge rectifier 426 comprised of four identical 1N 4004 diodes, a 1000 microfarad capacitor 428, a 12 volt, 1 amp voltage regulator 430, and a 0.1 microfarad capacitor 432. The two input leads of transformer 424 are connected to a pair of power input lines 432, 434 (FIGS. 1, 3 and 6) which are connected via a plug 436 (FIGS. 1 and 3) to an ordinary wall outlet. The two output leads of transformer 424 are connected to the two input leads of diode bridge rectifier 426 by a pair of lines 438, 440; the negative output of diode bridge rectifier 426 is connected to ground via a line 442 and the positive output of diode bridge rectifier 426 is connected to a line 444. One of the leads of capacitor 428 is connected to line 444 and the other lead of capacitor 428 is connected to ground. One of the leads of voltage regulator 430 is connected to the output of diode bridge rectifier 426 via the aforementioned line 444, another of the leads of voltage regulator 430 is connected to ground by a line 450, and the last lead of voltage regulator 430 is connected to a line 452. Line 452 is connected to one of the leads of capacitor 432 and also serves as one of the output lines of DC power supply circuit 408. The other lead of capacitor 432 is connected to ground. A grounded line 454 provides the other output line of DC power supply circuit 408.

Figure 3:
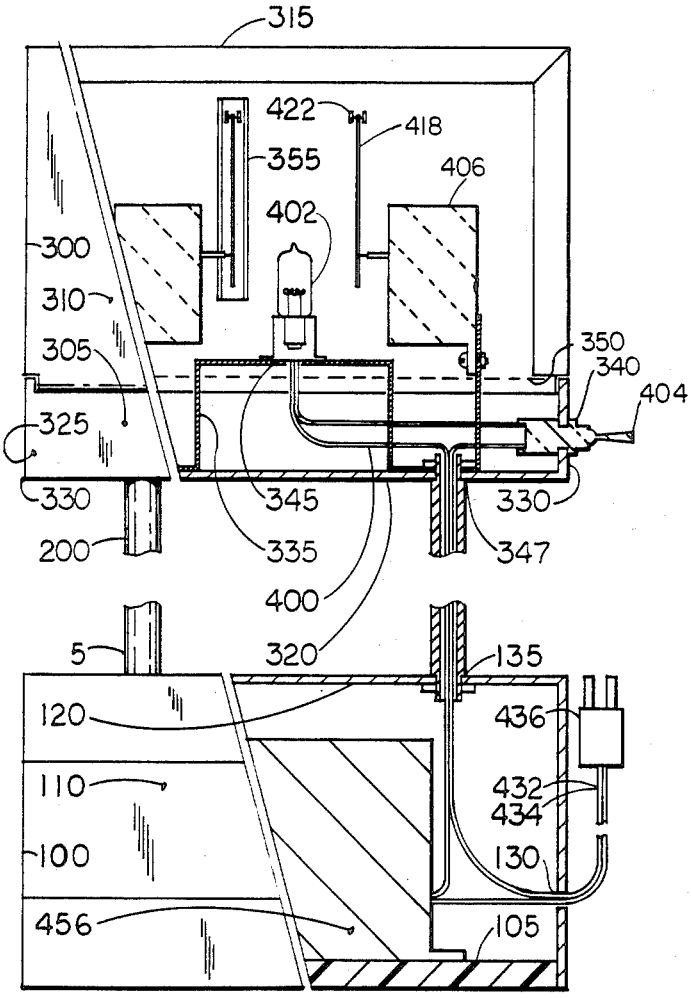
FIG. 3 is an elevational view, partially in section, of one side of the same light fixture.
Figure 4:
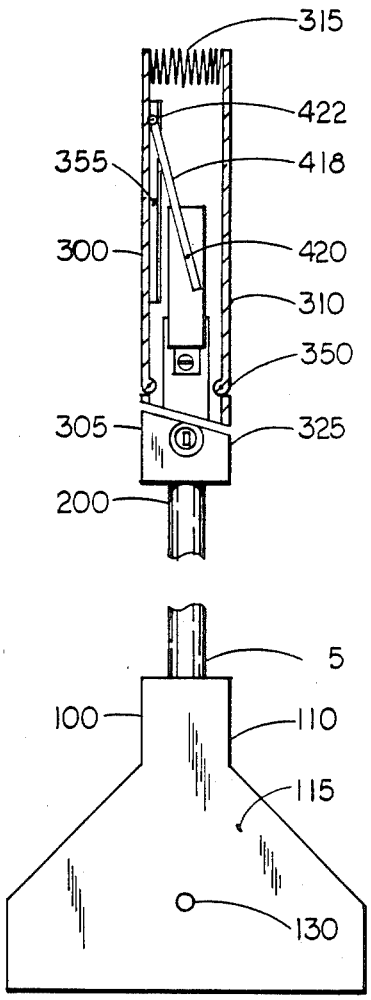
FIG. 4 is an elevational view, partially in section, of one end of the same light fixture.

The aforementioned power input lines 432 and 434 (which lead from wall plug 436) enter the light fixture's base 100 via the opening 130 formed in one of the base's end walls 115 (FIG. 3). Transformer 424 is located within fixture base 100, as are diode bridge rectifier 426, capacitor 428, voltage regulator 430 and capacitor 432. Diode bridge rectifier 426, capacitor 428, voltage regulator 430 and capacitor 432 are all mounted to a circuit board 456 (FIG. 3) which is also disposed within fixture base 100.

Still looking now at FIG. 6, motor control circuit 410 is adapted to alternately open up or close down the light fixture's panels 310 relative to one another in response to operator movement of switch 404. Motor control circuit comprises a NE 555 timer chip 458, a 2 microfarad capacitor 460, a 1N 4004 diode 462, a 4.7 K ohm resistor 464, a 1N 4004 diode 466, a 1.5 K ohm resistor 468, a 47K ohm resistor 470, a 470 K ohm resistor 472, a 180ohm resistor 474, a 10 K ohm trim resistor 476, a 10K ohm resistor 478, an N-P-N 2N6055 Darlington transistor element 480, and the 5K ohm servo pot 416A contained in servo 406A. With the exception of servo pot 416A, all of the foregoing elements of motor control circuit 410 are mounted to circuit board 456 which is disposed in fixture base 100. Servo pot 416A is, as noted previously, contained within servo 406A which is disposed inside enclosure 300. Lines connecting servo pot 416A with the remainder of motor control circuit 410 are contained within posts 200 and will hereinafter be described in greater detail.

The 12 volt output line 452 from DC power supply circuit 408 serves as one input to motor control circuit 410, and the grounded line 454 from DC power supply circuit 408 serves as another input to motor control circuit 410. Line 452 is connected to pin 4 of timer chip 458 by a line 481, to a line 482 which is in turn connected to the collector lead of Darlington transistor package 480, and to one lead of resistor 468. The other lead of resistor 468 is connected to one lead of servo pot 416A by a line 484. Another lead of servo pot 416 is connected via a line 486 to one lead of resistor 464. The final lead (i.e., the "wiper" lead) of servo pot 416A is connected by a line 488 to pin 7 of timer chip 458. One of the leads (the anode) of diode 462 is connected to line 488 by a line 490; the other lead of diode 462 is connected to one end of resistor 464 by a line 492. A line 494 connects line 492 to pin 6 of timer chip 458, and a line 496 connects line 492 to pin 2 of timer chip 458. Another line 498 connects line 492 to one of the leads of capacitor 460; the other lead of capacitor 460 is connected to ground, as is pin 1 of chip 458. Pin 5 of chip 458 is left unconnected. Pin 8 is connected to line 482 by a line 500. The grounded line 454 is connected to one of the leads of resistor 470. The other lead of resistor 470 is connected to one of the leads of resistor 472 via a line 502. Line 502 is also connected to one of the leads (the cathode) of diode 466 by a line 503; the other lead (the anode) of the diode is connected to the timer chip's pin 3 via a line 504. The second lead of resistor 472 is connected to resistor 478 by a line 506, and the second lead of resistor 478 is connected to the base of Darlington transistor element 480 by a line 508. Another line 510 connects resistor 474 to line 506. A further line 512 connects resistor 474 to one of the inputs (i.e., the "wiper" lead) of resistor 476; another lead of resistor 476 is connected via a line 514 to the aforementioned line 482 and the final lead of resistor 476 is connected to ground by a line 516. The emitter lead of Darlington transistor element 480 is connected to lead 518 of switch 404 by a line 520.

A line 522 connects switch lead 518 to another switch lead 524. Another line 526 connects switch lead 528 to another switch lead 530, and switch lead 530 is itself connected to the grounded line 454 by a line 532. Another switch lead 534 is connected via a line 536 to another line 538, which itself extends between one pole of servo motor 414A and the like pole of servo motor 414B. The final switch lead 540 is connected via a line 542 to a line 544 which itself extends between the other pole of servo motor 414A and the like pole of the other servo motor 414B.

Lamp dimmer circuit 412 is adapted to simultaneously brighten or dim light bulb 402 in response to movement of switch 404. Lamp dimmer circuit 412 comprises a diode rectifier bridge 546 comprised of four identical 1N 4004 diodes, a 4.7 microfarad capacitor 548, an SCR device 550, a 180 ohm resistor 552, a 220 ohm resistor 554, an MOC3011 photo triac optoisolator element 556, a 220 ohm resistor 558, a 400 volt, 10 amp high power triac 560, the light bulb 402, and the 5K ohm servo pot 416B contained in servo 406B. With the exception of light bulb 402 and servo pot 416B, all of the foregoing elements of lamp dimmer circuit 412 are mounted to the aforementioned circuit board 456 which is disposed in fixture base 100. Light bulb 402 is, as noted above, attached to mounting bracket 335 and disposed within enclosure 300. Servo pot 416B is, as noted above, contained within servo 406B which is also disposed within enclosure 300. Lines connecting light bulb 402 and servo pot 416B with the remainder of lamp dimmer circuit 412 are contained within posts 200 and will hereinafter be described in greater detail.

One of the input leads of diode rectifier bridge 546 is connected to the output line 438 of transformer 424 by a line 562, and another input lead of diode rectifier bridge 546 is connected to the other output line 440 of transformer 424 by a line 564. Another lead (negative output) of diode rectifier bridge 546 is connected to ground by a line 566. The final lead (positive output) of diode rectifier bridge 546 is connected to the anode of SCR device 550 by a line 568. Line 568 is also connected to one of the input leads of the 5K pot 416B contained in servo 406B by a line 570. The gate lead of SCR device 550 is connected to one of the leads of resistor 552 by a line 572; the other lead of resistor 552 is connected to the "wiper" lead of pot 416B by a line 574. The final lead of pot 416B is connected to line 574 by another line 576. Line 574 is also connected to one of the leads of capacitor 548 by a line 578; the other lead of capacitor 548 is connected to ground.

The cathode lead of SCR device 550 is connected via a line 580 to one lead of resistor 554. The other lead of resistor 554 is connected to one of the leads of optoisolator element 556 via a line 582. Another lead of optoisolator element 556 is connected to ground via a line 584. A third lead of optoisolator element 556 is connected to power input line 434 via a line 586. The fourth lead of optoisolator element 556 is connected to one of the leads of resistor 558 via a line 588. The other lead of resistor 558 is connected to the gate lead of high power triac 560 via a line 590. Another lead of triac 560 is connected to power input line 434 via a line 592, and the final lead of triac 560 is connected to halogen bulb 402 by a line 594. The other lead of bulb 402 is connected to power line 432 via a line 596.

On account of the foregoing construction, when toggle switch 404 is thrown in a first direction, servo motors 414A,414B will be activated by motor control circuit 410 so as to open panels 310 outward, expanding enclosure 300. Simultaneously, light bulb 402 will increase in intensity due to the increased current directed to the bulb by lamp dimmer circuit 412. The combination of expanding enclosure 300 and increasing the intensity of light bulb 402 results in increased illumination from light fixture 5.

Conversely, when toggle switch 404 is thrown in a second, opposite direction, servo motors 414A,414B will be activated by motor control circuit 410 so as to close panels 310 inward, contracting enclosure 300. Simultaneously, light bulb 402 will decrease in intensity due to the decreased current directed to the bulb by lamp dimmer circuit 412. The combination of contracting enclosure 300 and decreasing the intensity of light bulb 402 results in decreased illumination from light fixture 5.

It is to be appreciated that when the double-pole, double-throw, spring-return-to-center toggle switch 404 is left untouched, the self-centering switch will be in its "off" position, whereby the light fixture will remain in precisely its then-current state.

It is to be appreciated that on account of the fact that the "wiper" lead of the 5K ohm pot 416A in servo 406A constitutes one of the inputs to motor control circuit 410, motor control circuit 410 is adapted to move panels 310 with a constant angular speed regardless of the particular angular position of panels 310 at any given time. This result is achieved since the width of the pulses applied to the base lead of Darlington transistor package 480 is automatically controlled by the position of the "wiper" of the 5K ohm pot 416A in servo 406A.

MODIFICATIONS OF THE PREFERRED EMBODIMENT

It is, of course, possible to modify the preferred embodiment of the present invention without departing from the scope of the present invention.

Thus, for example, two bulbs might be substituted for the single light bulb 402 described above, or a single post or more than two posts might be substituted for the two posts 200 described above. It is also anticipated that base 100 and/or posts 200 might be eliminated, e.g. as in the case of a ceiling or wall mounted light fixture. Also, a switch other than the double-pole, double-throw, spring-return-to-center toggle switch 404 might be used.

It is also anticipated that one might replace switch 404 with two different switches, and replace DC power supply circuit 408, motor control circuit 410 and lamp dimmer circuit 412 with alternative circuit elements so that one switch controls the operation of servo motors 414A,414B to open and close enclosure 300, and the other switch controls the dimming and brightening of light bulb 402. Of course, this alternative construction is not preferred, not only because it disrupts the natural harmony created between simultaneous brightening or dimming light bulb 402 while simultaneously opening and closing enclosure 300, but also because it creates the possibility that light bulb 402 may be set at its maximum intensity while enclosure 300 is closed up to its smallest position; this arrangement is undesirable, since it may allow excessive heat to build up inside the enclosure, creating the possibility of fire.

It is also anticipated that base 100 and posts 200 might be eliminated and one of the panels 310 mounted to a wall, with the other panel 310 moving towards or away from the fixed panel as the light fixture is closed down or opened up, respectively.

It is also anticipated that one might alter the design of enclosure 300 to something other than a book-like shape, e.g. enclosure 300 might have a flower-like configuration made up of more than two panels 310.

These changes, and other changes of their type, will be obvious to a person skilled in the art and are considered to be within the scope of the present invention.

ADVANTAGES OF THE PRESENT INVENTION

The present invention provides a variable illumination light fixture wherein the level of illumination of the light fixture is adjustable not only by dimming or brightening the intensity of the fixture's one or more light bulbs, but also by simultaneously closing off from view or opening up to view the light fixture's one or more light bulbs.

The present invention also provides a variable illumination light fixture which is simple to construct, inexpensive to manufacture, and reliable in operation.

What we claim is:

1. A variable intensity light fixture comprising:

(a) at least one light bulb;

(b) an enclosure for containing said at least one light bulb, said enclosure comprising an enclosure base, a pair of panels hinged to said enclosure base, and a light-pervious bellows attached to said enclosure base and extending between said two panels so as to complete said enclosure;

(c) first means for alternately opening up or closing down said enclosure by moving said enclosure's panels away from or towards one another, respectively; and (d) second means for alternatively brightening or dimming the intensity of said at least one light bulb contained within said enclosure, said second means being linked to said first means so that (1) said enclosure can be opened up and the intensity of said at least one light bulb simultaneously increased so as to increase the illumination of said light fixture, or (2) said enclosure can be closed down and the intensity of said at least one light bulb simultaneously decreased so as to decrease the illumination of said light fixture.

2. A variable intensity light fixture according to claim 1 wherein said light-pervious bellows is formed out of paper.

3. A variable intensity light fixture according to claim 1 wherein said light-pervious bellows includes ventilation holes formed therein.

4. A variable intensity light fixture according to claim 1 wherein said panels are light-impervious.

5. A variable intensity light fixture according to claim 1 wherein said panels are hinged to said enclosure base by hinges.

6. A variable intensity light fixture according to claim 1 wherein said first means comprises two servos each including a pot and a motor, and further wherein said second means is linked to one of said pots.

* * * * *